US009234385B2

(12) United States Patent
Dreux et al.

(10) Patent No.: US 9,234,385 B2
(45) Date of Patent: Jan. 12, 2016

(54) INSULATED GLAZING PANEL COMPRISING AT LEAST ONE INTERNAL SPACE CONTAINING A LAYER OF AN INSULATING GAS AND METHOD OF MANUFACTURING SUCH A GLAZING PANEL

(75) Inventors: Priscille Dreux, Jumet (BG); Xavier Sahyoun, Jumet (BG)

(73) Assignee: AGC Glass Europe, Brussels (BE)

( * ) Notice: Subject to any disclaimer, the term of this patent is extended or adjusted under 35 U.S.C. 154(b) by 0 days.

(21) Appl. No.: 14/130,774

(22) PCT Filed: Jun. 20, 2012

(86) PCT No.: PCT/EP2012/061829

§ 371 (c)(1), (2), (4) Date: Jan. 3, 2014

(87) PCT Pub. No.: WO2013/010743

PCT Pub. Date: Jan. 24, 2013

(65) Prior Publication Data

US 2014/0130428 A1 May 15, 2014

(30) Foreign Application Priority Data

Jul. 20, 2011 (BE) ..... 2011/0469

(51) Int. Cl.
*E06B 7/00* (2006.01)
*E06B 3/663* (2006.01)
(Continued)

(52) U.S. Cl.
CPC ..... *E06B 7/00* (2013.01); *E06B 3/66314* (2013.01); *E06B 3/677* (2013.01); *E06B 3/67326* (2013.01); *Y10T 29/49117* (2015.01)

(58) Field of Classification Search
CPC ..... E06B 3/6722; E06B 3/677; E06B 3/6715; E06B 9/24; E06B 3/67326; E06B 7/00
USPC ..... 52/171.3, 208, 786.1, 786.13, 204.52, 52/209, 788.1, 204.593, 204.6, 302.7, 52/173.1; 219/522, 203, 541, 538; 428/34; 49/471
See application file for complete search history.

(56) References Cited

U.S. PATENT DOCUMENTS 2,213,395 A * 9/1940 Hopfield ..... 156/109
2,756,467 A * 7/1956 Etling ..... 428/34
(Continued)

FOREIGN PATENT DOCUMENTS

DE 103 22 561 12/2004
EP 1 529 922 5/2005

OTHER PUBLICATIONS

U.S. Appl. No. 14/235,973, filed Jan. 29, 2014, Caliaro, et al.
(Continued)

*Primary Examiner* — Beth Stephan
(74) *Attorney, Agent, or Firm* — Oblon, McClelland, Maier & Neustadt, L.L.P.

(57) ABSTRACT

The invention relates to a glazing panel (100), particularly an insulated glazing panel, comprising at least a first (10) and a second (11) sheet of glass which are joined together by an intercalated surround (12) which holds them a certain distance apart, and between said at least two sheets of glass at least one internal space (15) closed by the intercalated surround positioned around said internal space. According to the invention, the intercalated surround (12) comprises an opening (122) causing the internal space (15) to communicate with the outside of the panel, the panel comprises at least one electrically conducting element (14) inserted into the opening, a first end (141) of the conducting element being situated inside the internal space and a second end (142) of the conducting element being situated outside the internal space, and the panel also comprises a first plug (17) of thermoplastic elastomer material closing the opening (122) around the electric conducting element.

18 Claims, 3 Drawing Sheets

(51) Int. Cl.

| | |
|---|---|
| ***E06B 3/673*** | (2006.01) |
| ***E06B 3/677*** | (2006.01) |

(56) References Cited

U.S. PATENT DOCUMENTS

| | | | | | |
|---|---|---|---|---|---|
| 3,470,049 | A | * | 9/1969 | Reusch | 156/145 |
| 3,760,157 | A | * | 9/1973 | Newman et al. | 219/522 |
| 3,940,898 | A | * | 3/1976 | Kaufman | 52/204.597 |
| 4,093,352 | A | * | 6/1978 | Pisar | 359/886 |
| 4,208,848 | A | * | 6/1980 | Kohl | 52/171.3 |
| 4,390,240 | A | * | 6/1983 | Bookbinder | 359/591 |
| 4,593,175 | A | * | 6/1986 | Bowser et al. | 219/203 |
| 4,692,744 | A | * | 9/1987 | Hickman | 340/550 |
| 5,792,523 | A | * | 8/1998 | McHugh, III | 428/34 |
| 5,852,284 | A | * | 12/1998 | Teder et al. | 219/522 |
| 6,144,017 | A | * | 11/2000 | Millett et al. | 219/522 |
| 6,397,662 | B1 | * | 6/2002 | Alkhoury | 73/31.04 |
| 6,701,681 | B2 | * | 3/2004 | Kim | 52/171.3 |
| 2003/0150174 | A1 | * | 8/2003 | Kim | 52/171.3 |
| 2004/0040228 | A1 | * | 3/2004 | Emde et al. | 52/173.3 |
| 2006/0099833 | A1 | * | 5/2006 | Mann | 439/63 |
| 2007/0193138 | A1 | * | 8/2007 | Langlais et al. | 52/204.5 |
| 2007/0204531 | A1 | * | 9/2007 | Gerhardinger et al. | 52/173.3 |
| 2007/0267150 | A1 | * | 11/2007 | Schaumberger et al. | 160/7 |
| 2010/0287851 | A1 | * | 11/2010 | Kindschuh | 52/171.3 |
| 2013/0081338 | A1 | * | 4/2013 | Sagdic et al. | 52/173.3 |

OTHER PUBLICATIONS

International Search Report Issued Jul. 17, 2012 in PCT/EP12/061829 Filed Jun. 20, 2012.

U.S. Appl. No. 14/343,242, filed Mar. 6, 2014, Dreux.

* cited by examiner

INSULATED GLAZING PANEL COMPRISING AT LEAST ONE INTERNAL SPACE CONTAINING A LAYER OF AN INSULATING GAS AND METHOD OF MANUFACTURING SUCH A GLAZING PANEL

CROSS REFERENCE TO RELATED APPLICATIONS

The present application is a 35 U.S.C. §371 national stage patent application of International patent application PCT/EP2012/061829, filed on Jun. 20, 2012, published as WO/2013/010743 on Jan. 24, 2013, the text of which is incorporated by reference, and claims the benefit of the filing date of Belgian application no. BE 2011/0469, filed on Jul. 20, 2011, the text of which is also incorporated by reference.

1. FIELD OF THE INVENTION

The field of the invention is that of glazing panels comprising sheets of glass delimiting internal spaces. The invention notably relates to such a panel that comprises at least one component designed to be fed with an electrical or electronic signal.

These panels can be used in all kinds of applications such as utility glazing, vehicle glazing or in buildings.

2. SOLUTIONS OF THE PRIOR ART

A glazing panel to which the invention relates is, for example, an insulating glazing panel also referred to as an "insulating glass unit".

Such an insulating glass unit comprises in the conventional way a first and a second sheet of glass which are joined together by an intercalated frame which keeps them parallel and a certain distance apart. The unit is closed at its periphery by a peripheral seal so that the space between the sheets of glass, also referred to as the internal space, is completely closed off.

The internal space may be evacuated of any gas, and the glazing is then referred to as vacuum glazing. Energy transfer across a vacuum insulating glazing unit is greatly reduced by the vacuum space.

The internal space may also trap within it a layer of gas, traditionally dry air. Energy transfer across an insulating unit with this conventional structure is reduced because of the presence of the layer of air in the internal space by comparison with a single sheet of glass.

Energy transfer can be further reduced by increasing the thickness of the internal space in order to increase the insulation produced by the layer of air. However, there is a limit on the thickness of the internal space beyond which the convection within the layer of air between the sheets of glass causes the energy transfer to increase.

Energy transfer can also be reduced by adding additional layers in the form of additional internal spaces flanked by additional sheets of glass. For example, three parallel sheets of glass separated by two internal spaces and sealed at their peripheries using a seal. Thus, the thicknesses of the internal spaces can be kept below the maximum limit set by the effects of convection in the layers of air and energy transfer can thus be further reduced.

Moreover, energy transfer can also be reduced by substituting for the air ($N_2$, $O_2$) a gas that is more dense and a poorer conductor of heat. Suitable gases need to be colorless, non-toxic to man (at least below reasonable concentrations), non-corrosive, non-flammable, insensitive to exposure to ultraviolet radiation, more dense than air and have a lower thermal conductivity. Argon (Ar), krypton (Kr), xenon (Xe) and sulfur hexafluoride ($SF_6$) are examples of such gases which are commonly substituted for air in insulating glass units.

Glass units incorporating electronic components, such as light emitting diodes (LEDs), for example for displaying information or for lighting applications are also known (for example from EP1840449). In the context of these applications, the manufacture of a glass unit incorporating electronic components typically involves a stage of applying a transparent conducting layer to the first sheet of glass, a step of creating the conducting tracks of the internal conducting circuit using the transparent conducting layer and a step of placing and attaching (for example using a conducting adhesive) electronic components on the conducting tracks of the internal conducting circuit. The glass unit is obtained by applying the second sheet of glass to the intercalated frame, all of this being closed at its periphery using a peripheral seal so that the internal space between the sheets of glass is completely closed off.

In the case of this LED unit, in order to connect the internal conducting circuit to an external electrical circuit (which means external to the glass unit), such as external electrical supply, it is necessary, before the unit is closed, to incorporate an electrically conducting element, for example an electric wire, one end of which is electrically connected to the inside of the glass unit and the other end of which extends beyond the edges of the unit.

Document EP1529922 illustrates such an electrically conducting element in the form of a connector in a double glazing unit. The connector allows electrical signals to be conveyed from outside to inside the double glazing unit via the intercalated system. As illustrated notably in FIG. 1 of this document, this connector consists of a wedge-shaped component which is designed to be interconnected between two branches of the intercalated frame 3 of the double glazing.

This type of connector in the form of a molded component designed to be inserted into two branches of an intercalated frame is specially designed for a given intercalated frame and can therefore not be fitted to other intercalated frames which, for example, have different dimensions. Now, the double glazing unit market is such that the space between the first and second sheets of glass can generally vary between 6 and 27 mm according to customer requirements. Likewise, there are various cross sections and dimensions of intercalated frames which vary according to the country in which the frame is sold or used. That therefore entails the creation of a component mold for each type of intercalated system and each double glazing unit space so as to be able to provide a wide product range including this component.

Furthermore, such a connector is generally designed to be inserted into a determined peripheral region of the glazing and does not leave much scope for the positioning of the component in the glazing.

3. OBJECTIVES OF THE INVENTION

One notable objective of the invention is to alleviate these disadvantages of the prior art.

More specifically, one objective of the invention, in at least one of its embodiments, is to provide a technique that allows the electrical connection to be made from the outside to the inside of a glass unit comprising at least two sheets of glass delimiting an internal space while at the same time preserving such good thermal insulation properties as the unit might have in the case of an insulating glass unit.

Another objective of the invention, in at least one of its embodiments, is to employ such a technique that can be adapted to suit any type of glass unit comprising at least two sheets of glass delimiting an internal space, the thickness of which is controlled by an intercalated frame.

Another objective of the invention, in at least one of its embodiments, is to employ such a technique which does not require the design of a component specifically adapted to suit the dimensions of the unit and notably the dimensions of an intercalated system separating the two sheets of glass.

Another objective of the invention, in at least one of its embodiments, is to employ such a technique that provides a great deal of scope for positioning the electrical connection within the unit and/or which allows as many electrical connections from the outside to the inside of the unit to be made as are needed.

The invention, in at least one of its embodiments, has the further objective of providing such a unit which is simple to produce and can be produced at low cost.

4. SUMMARY OF THE INVENTION

According to one particular embodiment, the invention relates to a glazing panel, particularly an insulating glass unit, comprising at least a first and a second sheet of glass which are joined together via an intercalated frame which keeps them a certain distance apart and, between said at least two sheets of glass, at least one internal space containing a layer of insulating gas closed by the intercalated frame arranged around said internal space.

According to the invention, in such a glass unit, the intercalated frame comprises an opening that causes the internal space to communicate with the outside of the unit.

Again according to the invention, the unit comprises at least one electrically conducting element inserted in the opening, a first end of the conducting element being situated in the internal space and a second end of the conducting element being situated outside the internal space.

Again according to the invention, the unit also comprises a first plug of thermoplastic elastomer material that closes the opening around the electrically conducting element.

The general principle of the invention relies on the creation, in the existing intercalated frame of a conventional glass unit, of an opening that causes the internal space to communicate with the outside of the unit and allows the insertion of (a) conducting element(s) to make the electrical connection from the outside to the inside of a unit. The first plug of thermoplastic elastomer material provides sealing and therefore, in the case of an insulating glass unit, makes it possible to preserve good thermal insulation properties that the unit might have.

Thus, because the hole can be made in any type of intercalated frame, such a connection technique can be adapted to suit any type of multiple glazing unit with an intercalated frame. Furthermore, such a technique does not require the design of a component specifically tailored to the dimensions of the unit and notably to the dimensions of an intercalated system separating the two sheets of glass.

Moreover, because the hole can be made at any point on the intercalated frame, such a connection technique according to the invention allows a great deal of scope in the positioning of the electrical connection in the unit and/or allows as many electrical connections from the outside to the inside of the unit to be made as are needed.

Further, by comparison with the conventional techniques that use specifically designed connectors, as described in document EP1529922, the connection technique according to the invention is simple and inexpensive.

Advantageously, the thermoplastic elastomer material consists at least partially of synthetic rubber.

According to one advantageous embodiment of the invention, the thermoplastic elastomer material is polyisobutylene.

Advantageously the unit comprises, in the internal space, at least one insulating substrate coated, at least in part, with at least one conducting track electrically connected to the second end of the conducting element.

According to one advantageous embodiment of the invention, the insulating substrate coated, at least in part, with at least one conducting track is a printed circuit board.

Advantageously, the conducting element is an electric cable comprising at least one longilinear conducting element protected by an insulating sheath.

Advantageously, the sheath consists at least in part of low density polyethylene (also known by the acronym PELD and defined such that its density is around about 0.92), of high density polyethylene (also known by the acronym PEHD and defined such that its density is around about 0.95) and of polyamide. For example, the sheath is a sheath referenced RBK-ILS-125-NR3-0-65MM and marketed by the company Tyco Electronics.

This then yields very good sealing because of the fact that the combination of these three materials of the sheath displays excellent adhesion with the polyisobutylene of the first plug.

According to one advantageous embodiment of the invention, the first end of the electric cable is embedded in a second plug of thermoplastic elastomer material.

Advantageously, the unit comprises a reservoir attached inside the internal space to the intercalated frame so that it can be positioned facing the opening, the reservoir comprising a through-hole through which the second end of the electric cable can pass and, advantageously also, the insulating substrate coated, at least in part, with at least one conducting track is arranged in a slot made in one side of the reservoir so that a portion of the insulating substrate coated, at least in part, with the conducting track is located inside the reservoir, the second plug of thermoplastic elastomer material filling the empty space inside the reservoir.

According to one advantageous embodiment of the invention, the internal space contains a layer of insulating gas.

The invention, in at least one of its embodiments, also relates to a method of manufacturing a glazing panel, particularly an insulating glass unit, comprising at least a first and a second sheet of glass which are joined together via an intercalated frame which keeps them a certain distance apart and, between said at least two sheets of glass, at least one internal space closed by the intercalated frame arranged around said internal space.

According to the invention, the method comprises the following steps:

- creating an opening in the intercalated frame to make the internal space communicate with the outside of the unit,
- inserting at least one electrically conducting element in the opening, a first end of the conducting element being situated inside the internal space and a second end of the conducting element being situated outside the internal space;
- closing the opening around the electrically conducting element using a first plug of thermoplastic elastomer material.

Advantageously, the method according to the invention comprises a step of inserting, in the internal space, at least one insulating substrate coated, at least in part, with at least one conducting track and a step of making an electrical connection between the conducting track and the second end of the conducting element.

Advantageously, the method according to the invention comprises a step of embedding the first end of the electrical cable in a second plug of thermoplastic elastomer material.

Of course, the first and second plugs may be separate or may form one single overall plug.

Advantageously, the method according to the invention comprises the following steps:

- attaching a reservoir inside the internal space to the intercalated frame so that it is positioned facing the opening, the reservoir having a through-hole through which the second end of the electrical cable can pass,
- positioning the insulating substrate that is coated, at least in part, with at least one conducting track, in a slot provided in one side of the reservoir so that a portion of the insulating substrate coated, at least in part, with the conducting track, is located inside the reservoir,
- filling the empty space in the reservoir with the second plug of thermoplastic elastomer material.

5. LIST OF FIGURES

Other features and advantages of the invention will become more clearly apparent from reading the following description of a preferred embodiment given simply by way of illustrative and nonlimiting example, and from studying the attached figures, among which:

FIG. 1 gives a view in cross section of a portion of an insulating glass unit according to one embodiment of the invention;

6. DESCRIPTION OF ONE EMBODIMENT OF THE INVENTION

Figure 1:
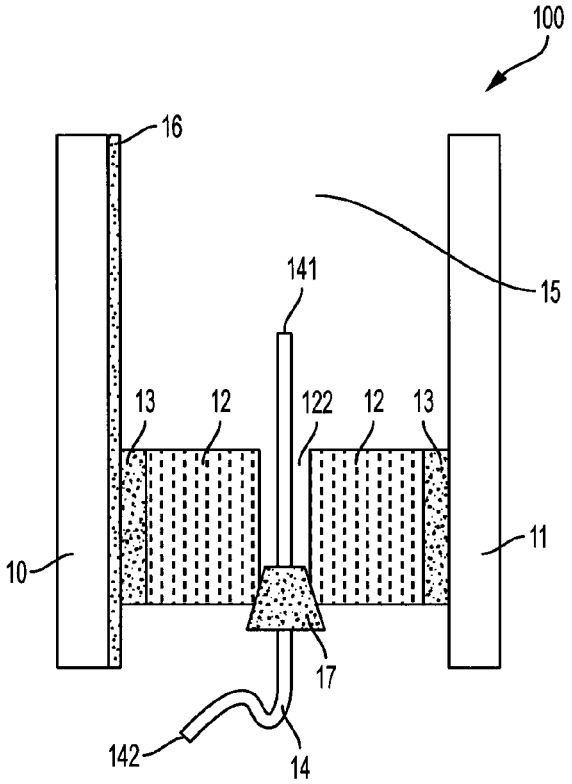
Figure 2:
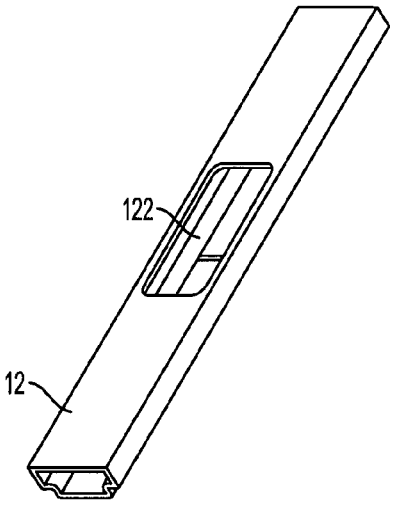
FIG. 2 illustrates a view of the intercalated frame of the unit of FIG. 1.

A view in cross section of a portion of a glass unit 100 according to one embodiment of the invention is discussed in conjunction with FIGS. 1 and 2.

The glass unit 100 is a double glazing unit comprising a first and a second sheet of glass 10, 11 (for example sheets of soda-lime-silica glass 4 mm thick) joined together by an intercalated frame 12 which keeps them a certain distance apart.

Between the two sheets of glass 10, 11 there is an internal space 15 containing a layer of an insulating gas and closed by the intercalated frame arranged around the internal space. For preference, a peripheral seal 13 provides sealing between the internal space and the outside.

The intercalated frame 12 (also referred to as a spacer) extends around the periphery of the sheets of glass and is made for example of galvanized steel 0.4 mm thick. The intercalated frame 12 has a hollow cross section which is, for example, in the shape of a square. For example, a pad of desiccant (not depicted in the figures) is placed inside the intercalated frame 12.

The peripheral seal 13 comprises sealing layers of polyisobutylene 13 arranged respectively between the intercalated frame 12 and each of the first and second sheets of glass 10, 11. For example, the polyisobutylene used has a permeability of around 0.11 g of water per mm of thickness per $m^2 \times 24$ h×kPa of water vapor. Advantageously, the peripheral seal 13 also comprises a bead of polysulfide or silicone resin arranged so as to be in contact with the sealing layers 13 between each of the sheets 10, 11 and the intercalated frame 12. An even more fluidtight peripheral seal may also be used, for example one based on soldered glass.

For example, the double glazing unit 100 further comprises a coating 16, for example a layer that reflects infrared radiation, for example a "Stopsol Super Silver" layer marketed by the company AGC Glass Europe.

Of course, the coating may also be situated for example over the entire internal surface of the second sheet of glass 11 or just over part of the internal face of one of the sheets of glass 10, 11.

For example, the internal space 15 comprises a layer of insulating gas containing, for example, a mixture of 90% argon and 10% dry air (by volume).

For preference, the layer of insulating gas is comprised between 10 and 15 mm. For example, in what follows, the layer of gas measures 11 mm thick.

The intercalated frame 12 comprises an opening 122 causing the internal space 15 to communicate with the outside of the unit. The unit comprises at least one electrically conducting element 14 inserted into the opening 122, a first end 141 of the conducting element being situated inside the internal space and a second end 142 of the conducting element being situated outside the internal space 15.

The opening can be made in any position on the intercalated frame (along a length of the glazing, on a width of the glazing or even in a corner).

FIG. 2 depicts a portion of the intercalated frame 12 having been bored all the way through to create the opening 122.

The unit also comprises a first plug 17 of thermoplastic elastomer material closing the opening 122 around the electrically conducting element 14. The first plug 17 according to the invention may adopt any suitable shape for closing the opening 122.

For preference, the thermoplastic elastomer material consists at least in part of synthetic rubber. More preferably still, the thermoplastic elastomer material is polyisobutylene.

Figure 3:
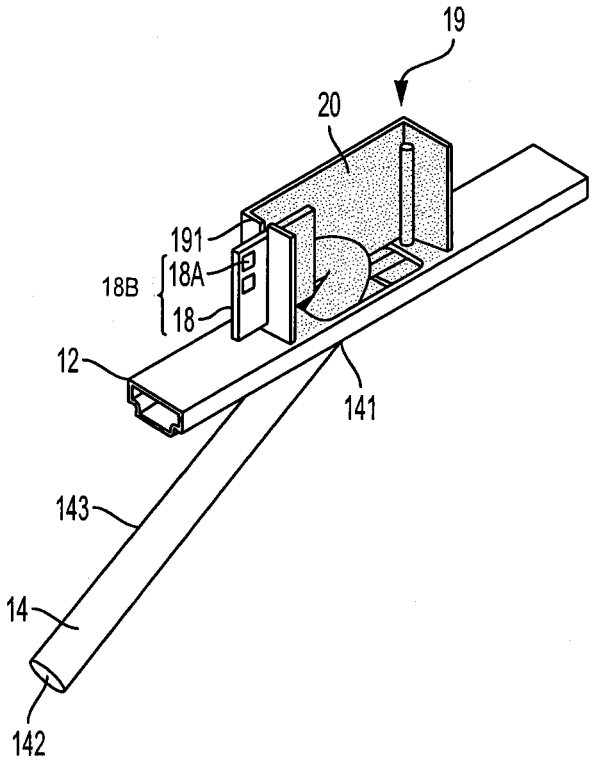
FIG. 3 illustrates one particular embodiment of the glass unit according to the invention in which the electrically conducting element is an electric cable comprising at least one longilinear conducting element protected by an insulating sheath.

One particular embodiment of the glass unit according to the invention, whereby the electrically conducting element is an electrical cable 14 comprising at least one longilinear conducting element, for example three conducting metal wires which are protected by an insulating sheath 143, is illustrated in conjunction with FIG. 3.

Of course, any number of longilinear conducting elements can be used, for example between 1 and 10 in number, or even a greater number.

For preference, the diameter of the electric cable does not exceed 60% of the thickness (separating the two sheets of glass 10, 11) of the intercalated frame.

For example, the insulating sheath 143 is made at least in part of low density polyethylene (also referred to by the abbreviation PELD and defined as having a density of around about 0.92), of high density polyethylene (also referred to by the abbreviation PEHD and defined such that its density is around about 0.95) and of polyamide. For example, the sheath is a sheath referenced RBK-ILS-125-NR3-0-65MM and marketed by the company Tyco Electronics.

Moreover, according to one preferred embodiment of the invention, housed inside the internal space 15 of the unit 100 is at least one insulating substrate 18, for example an insulating substrate that is coated, at least in part, with at least one conducting track that is electrically connected to the first end 141 of the electric cable. Advantageously, the insulating substrate 18 coated, at least in part, with at least one conducting track 18A is a printed circuit board 18B which is electrically connected to the first end 141 of the electric cable.

The first end 141 of the electric cable is embedded in a second plug 20 of thermoplastic elastomer material.

For preference, the thermoplastic elastomer material consists at least in part of synthetic rubber. More preferably still, the thermoplastic elastomer material is polyisobutylene.

The unit 100 comprises a reservoir 19 attached inside the internal space 15 to the intercalated frame 12 so that it can be positioned facing the opening 122, the reservoir 19 comprising a through-hole (not depicted) through which the first end 141 of the electric cable 14 can pass.

The opening 122 can be made for example by boring right through the thickness of the intercalated frame in order to obtain a through-hole. Because the intercalated frame has a square hollow cross section, boring is preferably performed on the wall of the intercalated system 12 that is on the inside of the glass unit 100 and also on the wall of the intercalated system 12 that is on the outside of the glass unit 100.

For preference, the first hole in the wall on the inside of the glass unit is dimensioned to accept the reservoir 19 and the second hole in the wall on the outside of the glass unit is dimensioned such that the first end 141 of the supply cable 14 can be inserted with a degree of inclination between the cable 14 and the intercalated frame 12, for example of between 30 and 90°. The second hole is bored so that it is offset from the first hole so that the cable 14 can be inserted with its degree of inclination with the end of the cable 14 placed in the end of the reservoir 19 closest to its rear face.

For example, the reservoir 19 is made of plastics material, for example of PA6. For preference, the reservoir 19 is of rectangular shape and has a small indentation in its base so that it can be inserted into the bored intercalated frame 12. One alternative to this way of embodying this reservoir 19 is to design a reservoir formed of two shells which fit one inside the other to make it easier to insert the printed circuit 18 connected to the cable 14 in this reservoir 19.

In the assembly phase, the cable 14 and the printed circuit 18 are first of all connected to one another. The reservoir 19 is positioned on the intercalated frame 12 over the first hole. The printed circuit board 18, connected to the cable 14, is introduced into a slot 191 provided in one side of the reservoir 19 so that a portion of the printed circuit (preferably that portion of the circuit that comprises the electrical track to which the first end 141 of the electric cable 14 is to be electrically connected) is located inside the reservoir 19.

The polyisobutylene of the second plug 20 is injected via the top face of the reservoir 19 to fill the empty space in the reservoir 19. This polyisobutylene overmolds the components situated inside the reservoir and part of the cable 14 on the back of the intercalated frame 12 on the side outside the glass unit.

For preference, the width of the slot 191 corresponds more or less to the width of the printed circuit board 18 so that no polyisobutylene can escape when the reservoir 19 is being filled.

According to one advantageous feature of the invention, a lid may be fitted to close the reservoir 19 in order to achieve a more aesthetic appearance after the polyisobutylene of the second plug 20 has been injected into the reservoir 19.

An embodiment of the invention in which the first and second plugs are separate has been described hereinabove. Of course, the invention also applies to the case of a single overall plug (for example made of polyisobutylene) which both closes the opening 122 around the electrically conducting element 14 and has the first end 141 of the electric cable embedded in it.

Figure 4:
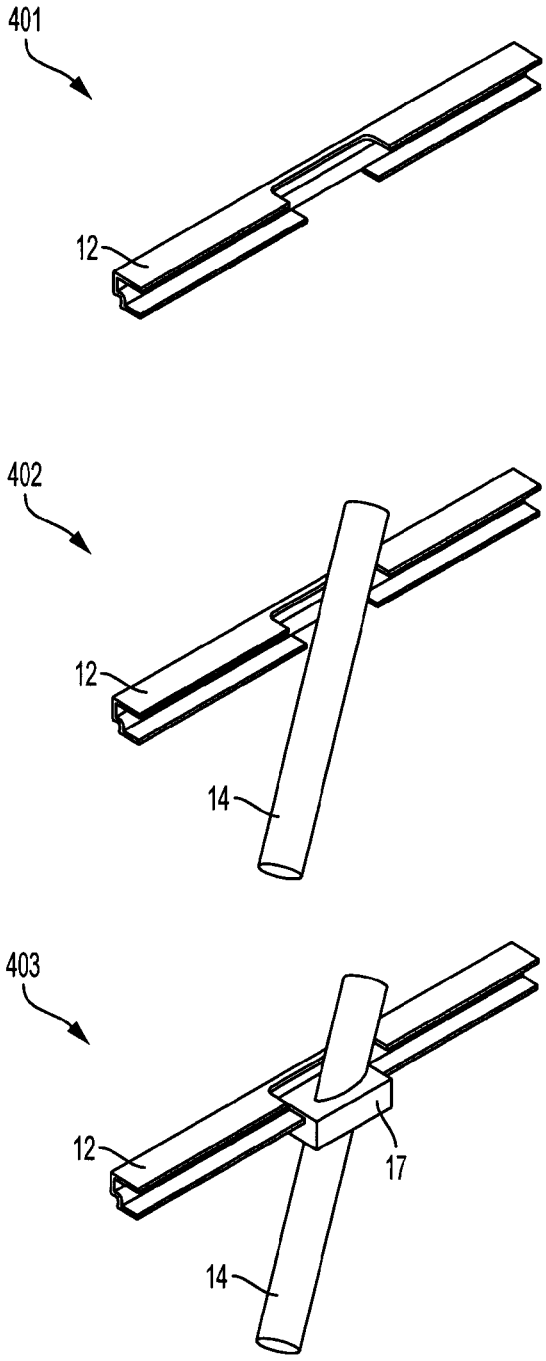
FIG. 4 is a flow diagram of the main steps in a method of manufacturing an insulating glass unit according to one embodiment of the invention.

A method of manufacturing a glass unit, particularly an insulating glass unit, according to one embodiment of the invention is illustrated in conjunction with FIG. 4.

The unit comprises at least a first and a second sheet of glass joined together by an intercalated frame which keeps them a certain distance apart and, between said at least two sheets of glass, at least one internal space closed by the intercalated frame arranged around said internal space.

The method comprises the following steps:

- creating 401 an opening in the intercalated frame to make the internal space communicate with the outside of the unit,
- inserting 402 at least one electrically conducting element in the opening, a first end of the conducting element being situated inside the internal space and a second end of the conducting element being situated outside the internal space;
- closing 403 the opening around the electrically conducting element using a first plug of thermoplastic elastomer material.

Of course, the invention is not restricted to the exemplary embodiments mentioned hereinabove.

In particular, while the invention has been illustrated hereinabove using insulating glass units, it also works with any type of glass unit, and notably with non-insulating glass units. The invention could, for example, be applied to the case of glazing with two sheets of glass separated by an intercalated frame designed to contain materials that are not allowed to come into contact with the external environment (for example viruses, bacteria, toxic gases, etc).

Moreover, a person skilled in the art will be able to vary the glass units according to the invention described in the preceding figures in any way. For example, the glass unit may comprise several internal spaces (e.g. triple glazing), each one containing for example a layer of vacuum or a layer of gas (any type of gas including air and mixtures of gases) or even a layer of liquid (where appropriate solids may also be contained in one or more of the internal spaces), the sheets of glass of the glass units according to the invention may be made of any type of glass, may be textured on the surface, may comprise any kind of coatings intended to perform any function or may themselves be made up of units of glass laminated with plastic interlayers, etc.

A glass unit according to the invention can be used in any type of application such as windows of buildings or of vehicles, partitions, walls, glazed openings (e.g. verandas, roofing elements, etc.), floors, staircases, etc.

The invention claimed is:

1. A glass panel comprising a first and a second sheet of glass joined together via an intercalated frame that separates the first and second sheets of glass by a certain distance and, between the first and second sheets of glass, an internal space closed by the intercalated frame arranged around the internal space, wherein:

- the intercalated frame comprises an opening to allow the internal space to communicate with the outside of the glass panel;
- the glass panel comprises an electrically conducting element inserted in the opening, a first end of the conducting element being situated in the internal space and a second end of the conducting element being situated outside the internal space;

the glass panel also comprises a first plug of a thermoplastic elastomer material that closes the opening around the electrically conducting element;

the glass panel further comprises an insulating substrate in the internal space, the insulating substrate coated, at least in part, with at least one conducting track electrically connected to the first end of the conducting element; and the glass panel additionally comprises a second plug of thermoplastic elastomer material in which the first end of the conducting element is embedded.

2. The glass panel of claim 1, wherein the thermoplastic elastomer material comprises a synthetic rubber.

3. The glass panel of claim 1, wherein the thermoplastic elastomer material comprises polyisobutylene.

4. The glass panel of claim 1, wherein the insulating substrate is a printed circuit board.

5. The glass panel of claim 1, wherein the electrically conducting element is an electric cable comprising a longilinear conducting element protected by an insulating sheath.

6. The glass panel of claim 5, wherein the sheath comprises a low density polyethylene, a high density polyethylene and a polyamide.

7. The glass panel of claim 1, further comprising a reservoir attached inside the internal space to the intercalated frame so that it can be positioned facing the opening, the reservoir comprising a through-hole through which the first end of the conducting element can pass, wherein:

the insulating substrate is arranged in a slot made in one side of the reservoir so that a portion of the insulating substrate is located inside the reservoir, and the second plug of thermoplastic elastomer material fills the empty space inside the reservoir.

8. The glass panel of claim 1, wherein the internal space comprises a layer of insulating gas.

9. A method of manufacturing the glass panel of claim 1, the method comprising:

creating the opening in the intercalated frame to make the internal space communicate with the outside of the glazing panel;

inserting the electrically conducting element in the opening, the first end of the conducting element being situated inside the internal space and the second end of the conducting element being situated outside the internal space; and closing the opening around the electrically conducting element using a first plug of thermoplastic elastomer material.

10. The glass panel of claim 5, wherein the insulating substrate is a printed circuit board.

11. The glass panel of claim 9, wherein the insulating substrate is a printed circuit board.

12. A glass panel comprising a first and a second sheet of glass joined together via an intercalated frame that separates the first and second sheets of glass by a certain distance and, between the first and second sheets of glass, an internal space closed by the intercalated frame arranged around the internal space, wherein:

the intercalated frame comprises an opening to allow the internal space to communicate with the outside of the glass panel;

the glass panel comprises an electrically conducting element inserted in the opening, a first end of the conducting element being situated in the internal space and a second end of the conducting element being situated outside the internal space;

the glass panel also comprises a first plug of a thermoplastic elastomer material that closes the opening around the electrically conducting element; and the electrically conducting element is an electric cable comprising a longilinear conducting element protected by an insulating sheath, and a first end of the electric cable is embedded in a second plug of thermoplastic elastomer material.

13. The glass panel of claim 12, wherein the thermoplastic elastomer material comprises a synthetic rubber.

14. The glass panel of claim 12, wherein the thermoplastic elastomer material comprises polyisobutylene.

15. The glass panel of claim 12, wherein the insulating substrate is a printed circuit board.

16. The glass panel of claim 12, wherein the sheath comprises a low density polyethylene, a high density polyethylene and a polyamide.

17. The glass panel of claim 12, further comprising a reservoir attached inside the internal space to the intercalated frame so that it can be positioned facing the opening, the reservoir comprising a through-hole through which the first end of the conducting element can pass, wherein:

the insulating substrate is arranged in a slot made in one side of the reservoir so that a portion of the insulating substrate is located inside the reservoir, and the second plug of thermoplastic elastomer material fills the empty space inside the reservoir.

18. The glass panel of claim 12, wherein the internal space comprises a layer of insulating gas.

* * * * *